US007095405B2

(12) United States Patent
Fujita

(10) Patent No.: US 7,095,405 B2
(45) Date of Patent: Aug. 22, 2006

(54) OUTPUT CONTROL CIRCUIT, DRIVING CIRCUIT, ELECTRO-OPTIC APPARATUS, AND ELECTRONIC INSTRUMENT

(75) Inventor: Shin Fujita, Chino (JP)

(73) Assignee: Seiko Epson Corporation, Tokyo (JP)

( * ) Notice: Subject to any disclaimer, the term of this patent is extended or adjusted under 35 U.S.C. 154(b) by 425 days.

(21) Appl. No.: 10/629,591

(22) Filed: Jul. 30, 2003

(65) Prior Publication Data

US 2004/0169623 A1 Sep. 2, 2004

(30) Foreign Application Priority Data

Aug. 9, 2002 (JP) ..... 2002-233880

(51) Int. Cl.
*G09G 5/00* (2006.01)

(52) U.S. Cl. ..... 345/204; 345/87; 345/98

(58) Field of Classification Search ..... 345/76, 345/80, 87, 90, 204–206
See application file for complete search history.

(56) References Cited

U.S. PATENT DOCUMENTS 6,362,643 B1 * 3/2002 Kim ..... 324/770
6,747,624 B1 * 6/2004 Udo et al. ..... 345/89
2003/0142053 A1 * 7/2003 Kumagai et al. ..... 345/87
2003/0231734 A1 * 12/2003 Fujita et al. ..... 377/64

FOREIGN PATENT DOCUMENTS

| | | |
|---|---|---|
| JP | A 5-216441 | 8/1993 |
| JP | 02-264578 | 4/1997 |
| JP | A 11-338440 | 12/1999 |

* cited by examiner

*Primary Examiner*—Amr A. Awad
*Assistant Examiner*—Tom Sheng
(74) *Attorney, Agent, or Firm*—Oliff & Berridge, PLC

(57) ABSTRACT

A data line driving circuit 200 has a shift resistor unit 210 in which respective shift resistor unit circuits Ua1 to Uan+2 are in cascade connection with each other, and an output signal control unit 220 comprising respective operational unit circuits Ub1 to Ubn+1. A NAND circuit 514 controls an enabling period of a negative sampling signal based on an output signal from a NAND circuit 511 in an subsequent-stage operational unit circuit.

14 Claims, 11 Drawing Sheets

OUTPUT CONTROL CIRCUIT, DRIVING CIRCUIT, ELECTRO-OPTIC APPARATUS, AND ELECTRONIC INSTRUMENT

BACKGROUND OF THE INVENTION

1. Field of Invention

This invention relates to an output control circuit for use with a transfer device in which a number of unit circuits that shift a starting pulse sequentially in synchronization with a clock signal are in cascade connection with each other, a driving circuit, an electro-optic apparatus, and an electronic instrument.

2. Description of Related Art

A driving circuit for an electro-optic apparatus, for example, a liquid crystal apparatus, can be formed by a data line driving circuit and scan line driving circuit that supply a data line signal and scan signal in, a predetermined timing, to data lines and scan lines wired in an image display area. A sampling circuit can be provided in a later stage of the data line driving circuit. The sampling circuit samples an image signal and supplies the image signal to each of the data lines based on each of sampling signals supplied from the data line driving circuit.

The conventional data line driving circuit generally has a shift resistor that shifts the starting pulse and an output control circuit that generates the sampling signals based on an output signal of each stages in the shift resistor.

Although it is ideal that each of the sampling signals becomes sequentially active exclusively, an enabling period of a sampling signal may overlap with an enabling period of a subsequent sampling signal by delay in a logic circuit forming the data line driving circuit.

To solve such problem, it can be considered that an enabling signal for enabling the sampling signals output from the output control circuit or an inhibiting signal for inhibiting the sampling signals is supplied, thereby pulse width of the sampling signals are controlled. However, when the data line driving circuit has a high operating frequency, since the period for inhibiting an adjacent sampling signal is shortened, the enabling signal and the inhibiting signal include an extremely high frequency component. On the other hand, since wiring for supplying the enabling signal and inhibiting signal has a floating capacitance, there is a certain limit in transmitting a high frequency signal through such wiring. Therefore, there has been a problem that when the data line driving circuit has a high operating frequency, the enabling signal and inhibiting signal cannot be transmitted adequately, resulting in overlap among the adjacent sampling signals.

Even when the enabling signal and inhibiting signal can be transmitted and the pulse width of the sampling signal can be limited, the reduced pulse width of the sampling signal causes a following problem. That is, while the image signal is supplied to the data line during an active period of the sampling signal, since the data line has a capacitance in itself, when the active period of the sampling signal is shortened, the image signal cannot be written in the data line adequately. This point becomes a more significant problem as the operating frequency of the data line driving circuit is increased.

SUMMARY OF THE INVENTION

The invention provides an output signal control circuit that eliminates the overlap among the active periods of the sampling signals and a driving circuit etc. using the output signal control circuit.

To solve the above mentioned problem, an output control circuit according to the invention, which is used with a transfer device having a number of unit circuits that shifts a starting pulse sequentially in synchronization with a clock signal in cascade connection with each other, and generates a set of a positive logic output signal and a negative logic output signal, which is an inversion of the positive logic output signal based on an output signal from each of the unit circuits. The output control circuit has a first logic operation unit that, based on an output signal from a unit circuit and an output signal from a subsequent-stage unit circuit, generates an output signal that is enabled in a period while the output signals from the two unit circuits are enabled at the same time, and a second logic operation unit that generates the positive logic output signal and the negative logic output logic based on the output signal from the first logic operation unit, and controls the enabling period of the positive logic output signal or the negative logic output signal based on an output signal from the first logic operation unit in a subsequent-stage output control circuit.

According to the invention, since the enabling period of the positive logic output signal or the negative logic output signal is controlled based on the output signal from the first logic operation unit in the subsequent-stage output control circuit, it is possible to adjust the enabling periods among output signals from the adjacent output control circuits so that the periods do not overlap with each other.

Here, it can be preferable that the second logic operation unit has a first system that generates the positive logic output signal based on the output signal from the first logic operation unit, and a second system that generates the negative logic output signal based on the output signal from the first logic operation unit. One of a system, the first system or the second system, having a longer delay time has a logic circuit that controls an enabling period of the positive logic output signal or the negative logic output, that should be generated from one of the system based on the output signal from the first logic operation unit in the subsequent-stage output control circuit. In the invention, since a logic circuit for timing adjustment is incorporated in the system having a longer delay time, the overlap of the enabling periods among the output signals from the adjacent output control circuits can be prevented.

It is preferable that when the output signal from the first logic operation unit is enabled at low level, the logic circuit in the second logic operation unit can be included in the second system and is a NAND circuit that controls the enabling period of the negative logic output signal based on the output signal from the first logic operation unit in the subsequent-stage output control circuit.

More specifically, it is preferable that the output signal from the unit circuit be enabled at high level, the first logic operation unit has the NAND circuit, the first system in the second logic operation unit has a first inverting circuit that inverts an output signal from the NAND circuit in the first logic operation unit and then outputs the signal as the positive logic output signal, and the second system in the second logic operation unit has a second inverting circuit that inverts the output signal from the NAND circuit in the first logic operation unit and then outputs the signal, and the logic circuit that operates inversion of a logical product of the output signal from the second inverting circuit and the output signal from the first logic operation unit in the subsequent-stage output control circuit and then outputs the inversion of the logical product as the negative logic output signal.

On the other hand, it is preferable that when the output signal from the first logic operation unit is enabled at high level, the logic circuit in the second logic operation unit is included in the first system and is a NOR circuit that controls the enabling period of the positive logic output signal based on the output signal from the first logic operation unit in the subsequent-stage output control circuit.

More specifically, it is preferable that the output signal from the unit circuit is enabled at low level, the first logic operation unit has the NOR circuit, the second system in the second logic operation unit has a first inverting circuit that inverts an output signal from the NOR circuit in the first logic operation unit and then outputs the signal as the negative logic output signal, and the first system in the second logic operation unit has a second inverting circuit that inverts the output signal from the NOR circuit in the first logic operation unit and then outputs the signal, and the logic circuit that operates the inversion of the logical sum of the output signal from the second inversion circuit and the output signal from the first logic operation unit in the subsequent-stage output control circuit and outputs the inversion of the logical sum as the positive logic output signal.

In the above mentioned output control circuit, a level conversion circuit that converts amplitude of a signal can be provided in a previous stage of the logic circuit. For example, when a signal having a large amplitude is sampled based on the positive logic output signal and the negative logic output signal from the output control circuit, a positive logic output signal having a large amplitude and a negative logic output signal having a large amplitude is necessary to drive the sampling circuit. Although the level conversion circuit is necessary in such case, the delay occurs even in the level conversion circuit. Therefore, in the invention, by providing the level conversion circuit in the previous stage of the logic circuit that controls the enabling period, the timing was adjusted so that no overlap occurs among the enabling periods including the delay occurred in the level conversion circuit.

More specifically, when the output signal from the unit circuit is enabled at high level, it is preferable that the first logic operation unit has the NAND circuit, the second logic operation unit has the second inverting circuit that inverts an output signal from the NAND circuit in the first logic operation unit, the level conversion circuit that converts respective amplitudes of the output signal from the NAND circuit in the first logic operation unit and the output signal from the second inversion circuit and then outputs the signals, the first inverting circuit that inverts the output signal, which is level converted, from the NAND circuit in the first logic operation unit, and then outputs the inverted signal as the positive logic output signal, and the logic circuit that operates inversion of a logical product of the output signal, which is level converted, from the second inverting circuit, and the output signal, which is level converted in the subsequent-stage output control circuit, from the first logic operation unit, and outputs the inversion of the logical products as the negative logic output signal.

On the other hand, when the output signal from the unit circuit is enabled at low level, it is preferable that the first logic operation unit has the NOR circuit, the second logic operation unit has the second inverting circuit that inverts the output signal from the NOR circuit in the first logic operation unit, the level conversion circuit that converts respective amplitudes of the output signal from the NOR circuit in the first logic operation unit and the output signal from the second inverting circuit and then outputs the signals, the first inverting circuit that inverts the output signal from the NOR circuit in the first logic operation unit, the signal having been subjected to the level conversion, and then outputs the signal as the negative logic output signal, and the logic circuit that operates the inversion of the logical sum of the output signal from the second inverting circuit, the signal having been subjected to the level conversion, and the output signal from the first logic operation unit, the signal having been subjected to the level conversion in the subsequent-stage output control circuit and outputs the inversion of the logical sum as the positive logic output signal.

Next, the output control circuit according to the invention may have an electric current amplification unit that is provided in a later stage of the second logic operation unit, and performs amplification of electric current for respective output signals from the second logic operation unit and then outputs the signals as the positive logic output signal and the negative logic output signal. In this case, a number of switching circuits etc. can be driven by one set of the positive logic output signal and the negative logic output signal.

The output control circuit according to the invention may have a holding unit that can be provided in the later stage of the second logic operation unit, and holds respective output signals from the second logic operation unit bi-directionally, and may output respective output signals from the holding unit as the positive logic output signal and the negative logic output signal. In this case, enabling periods of the positive logic output signal and the negative logic output signal can be agreed with each other.

Next, the driving circuit according to the invention, which drives an electro-optic device having a number of scan lines, a number of data lines, pixel electrodes and switching elements arranged in a matrix pattern corresponding to intersections of the scan lines and the data lines, can include a transfer device in which the unit circuits that shifts a starting pulse sequentially in synchronization with a clock signal are in a cascade connection with each other, and an output control device having a number of the above mentioned output control circuits. According to the driving circuit, output signals having enabling periods among which no overlap occurs can be obtained. Moreover, since no enabling signal or inhibiting signal is used, a high-frequency driving can be achieved, in addition, since no electric power is consumed for driving the enabling signal or the inhibiting signal, reduction of power consumption can be designed.

Next, the electro-optic apparatus according to the invention has a number of the scan lines, a number of the data lines, the pixel electrodes and the switching elements arranged in a matrix pattern corresponding to the intersections of the scan lines and the data lines, image signal lines for supplying image signals, a number of switching circuits provided corresponding to the data lines, in which an on/off control is performed by a set of a control signal that is enabled at high level and a control signal that is enabled at low level, one terminal is connected to the data lines, and the other terminal is connected to the image signal lines, and a driving circuit that supplies the positive logic output signal and the negative logic output signal to each of the switching circuits as the set of the control signals. According to the electro-optic device, since driving frequency of the driving circuit can be increased, and the enabling periods of respective control signals do not overlap with each other, a high-definition, clear image can be displayed.

Next, the electronic instrument of the invention can include the above mentioned electro-optic apparatus, including a viewfinder for use in a video camcorder, a cellular phone, a notebook-size computer, and a video projector as examples.

BRIEF DESCRIPTION OF THE DRAWINGS

The invention will be described with reference to the accompanying drawings, wherein like numbers represent like elements, and wherein.

DETAILED DESCRIPTION OF PREFERRED EMBODIMENTS

Hereinafter, embodiments of the invention are described with reference to drawings. First, as the electro-optic apparatus according to the invention, a liquid crystal apparatus using liquid crystal as an electro-optic material is exemplarily described. The liquid crystal apparatus has a liquid crystal panel AA as a major part. In the liquid crystal panel AA, an element substrate on which thin film transistors (TFT(s)) can be formed as switching elements and a counter substrate are adhered with each other with the surface for forming electrodes being faced and keeping a fixed clearance in which the liquid crystal is held tight.

Figure 1:
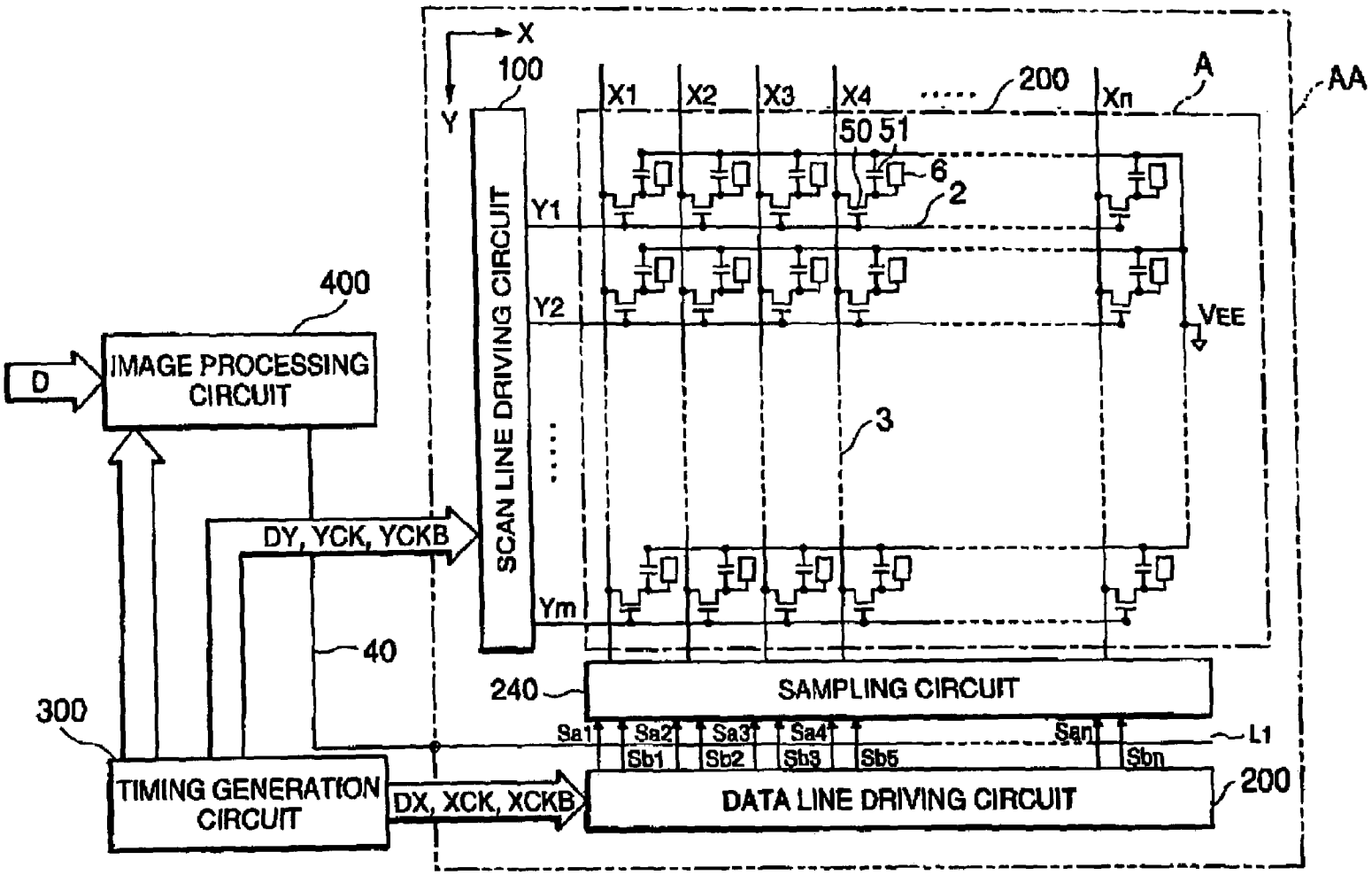
FIG. 1 is an exemplary block diagram showing a general configuration of the liquid crystal panel AA according to the invention.

FIG. 1 is an exemplary block diagram showing a general configuration of the liquid crystal apparatus according to the invention. The liquid crystal apparatus has a liquid crystal panel AA, a timing generation circuit 300, and an image processing circuit 400. The liquid crystal panel AA has, on the element substrate thereof, an image display area A, a scan line driving circuit 100, a data line driving circuit 200, a sampling circuit 240, and image signal supply lines L1.

An input image data D supplied to the liquid crystal apparatus is, for example, a 3-bits parallel format data. The timing generation circuit 300 can generate a Y clock signal YCK, an inverted Y clock signal YCKB, an X clock signal XCK, an inverted X clock signal XCKB, a Y transfer starting pulse DY, an X transfer starting pulse DX in synchronization with the input image data D, and supplies them to the scan line driving circuit 100 and data line driving circuit 200. The timing generation circuit 300 can generate various timing signals for controlling the image processing circuit 400 and outputs the signals.

Here, the Y clock signal YCK is a signal that specifies a period for selecting a scan line 2. The inverted Y clock signal YCKB is an inversion of logic level of the Y clock signal YCK. The X clock signal XCK specifies a period for selecting a data line 3. The inverted X clock signal XCKB is an inversion of logic level of the X clock signal XCK. The Y transfer starting pulse DY is a pulse for directing start of the selection of the scan line 2, on the other hand, the X transfer starting pulse DX is a pulse for directing start of the selection of the data line 3.

The image processing circuit 400 makes the gamma correction, and the like, in which the light transmittance characteristics of the liquid crystal panel are taken into consideration to the input image data D, and then performs a digital-to-analog conversion for the image data, thereby generates a image signal 40 and supplies the signal to the liquid crystal panel AA. In this example, in order to simplify the description, the image signal 40 is assumed to indicate a black-and-white gradation, however, it should be understood that the invention is not limited to this, and the image signal 40 may include an R signal, a G signal, and a B signal corresponding to respective colors of R, G, and B. In this case, three image signal supply lines are sufficiently provided.

Next, the scan line driving circuit 100 has a shift resistor, level shifter, and buffer. The shift resistor transfers the Y transfer starting pulse DY and generates a signal that becomes sequentially active in synchronization with the Y clock signal YCK and inverted Y clock signal YCKB. Respective output signals from the shift resistor are subjected to level conversion by the level shifter in order to achieve the on/off control for TFT 50, and subjected to the electric current amplification by the buffer, and then supplied to respective scan lines 2 as respective scan line signals Y1 to Ym.

Next, in the image display area A, as shown in FIG. 1, while m (m is a natural number larger than or equal to 2) scan lines 2 are formed in a parallel arrangement along X direction, n (n is a natural number larger than or equal to 2) data lines 3 are formed in a parallel arrangement along Y direction. In the vicinity of intersections of the scan lines 2 and data lines 3, while gates of the TFTs 50 are connected to the scan lines 2, sources of the TFTs 50 are connected to the data lines 3 and drains of the TFTs 50 are connected to pixel electrodes 6. Each of the pixels is formed by the pixel electrode 6, a counter electrode (described later) formed on the counter substrate, and the liquid crystal held tight between the both electrodes. As a result, the pixels are arranged in a matrix pattern corresponding to respective intersections of the scan lines 2 and data lines 3.

On respective scan lines 2 to which the gates of the TFTs 50 are connected, scan signals Y1, Y2, . . . , Ym are line-sequentially applied in a pulsed manner. Therefore, when a scan signal is supplied to a scan line 2, since TFT 50 connected to a corresponding scan line turns on, data line signals X1, X2, . . . , Xn that are supplied in a predetermined timing from the data lines 3 are written in corresponding pixels subsequently, and then held in a predetermined period.

Since orientation or order of liquid crystal molecules is changed depending on a voltage level applied on each pixel, a gradation display using an optical modulation can be achieved. For example, in the normally white mode, the quantity of light passing through the liquid crystal is more greatly limited with increase of the applied voltage, on the contrary, in the normally black mode, the quantity is more greatly relieved with increase of the applied voltage. Therefore liquid crystal apparatus as a whole, light having a contrast depending upon an image signal is emitted for each pixel. Thus, display can be made predeterminedly.

To prevent leakage of the held image signal, a storage capacitor 51 is added parallel with a liquid crystal capacitor formed between the pixel electrode 6 and the counter electrode. For example, since voltage of the pixel electrode 6 is held by the storage capacitor 51 in a period thousands times longer than a period during applying the source voltage, holding characteristics are improved, as a result, a high contrast ratio is achieved.

Next, the data line driving circuit 200 generates a sampling signal that becomes active sequentially in synchronization with the X clock signal XCK. The sampling signal is a signal in pairs, and a set of sampling signals can include a positive sampling signal that is active (enable) at high level and a negative sampling signal, which is an inversion of the positive sampling signal that is active at low level. The positive sampling signals Sa1 to San in respective sets become active exclusively, and the negative sampling signals Sb1 to Sbn in respective sets become active exclusively. Specifically, the sampling signals become active in order of Sa1, Sb1→Sa2, Sb2→, . . . , San, Sbn.

Figure 2:
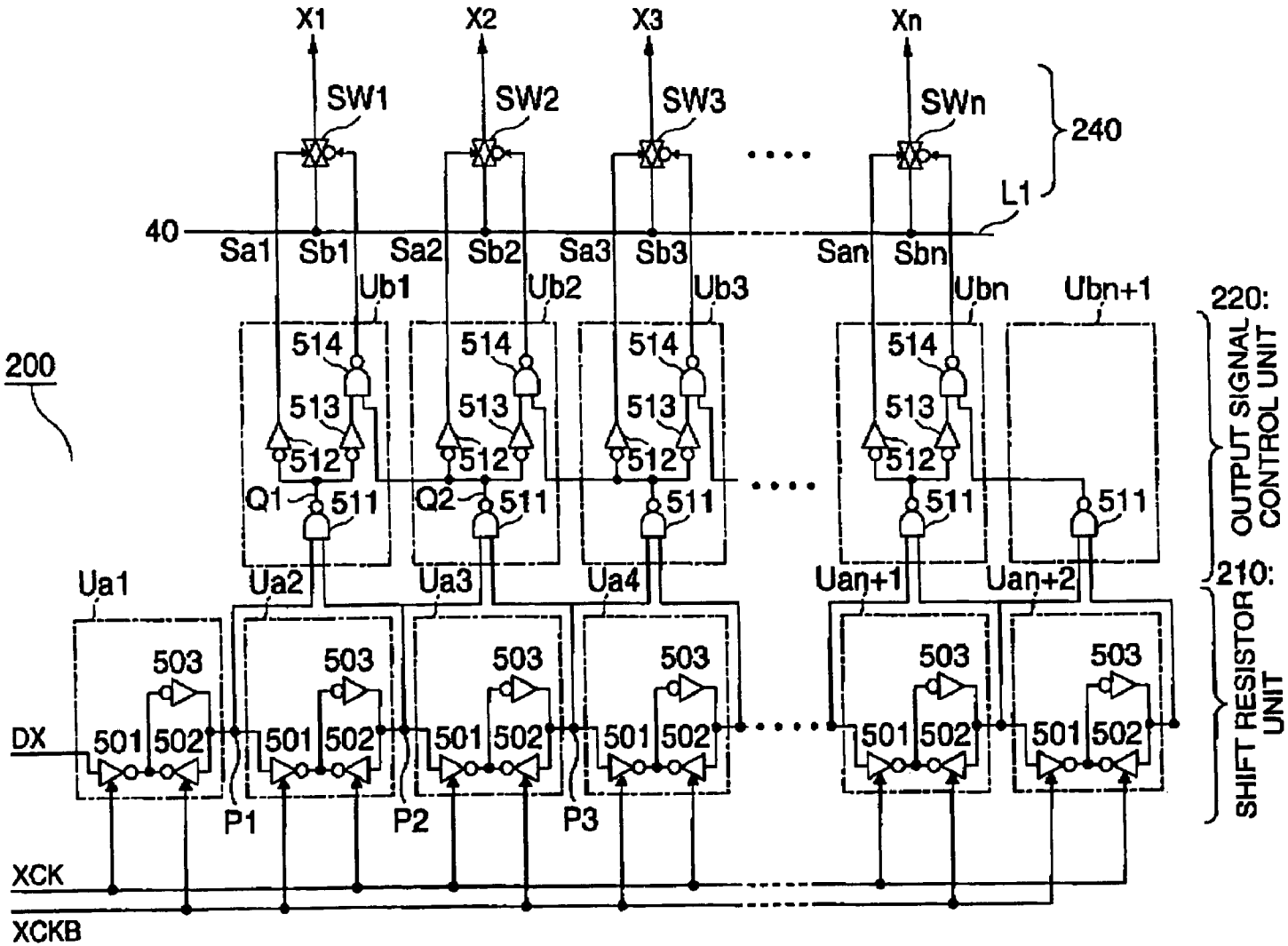
FIG. 2 is an exemplary circuit diagram showing a detailed configuration of the data line driving circuit 200 and sampling circuit 240 in the apparatus.

Next, FIG. 2 is a circuit diagram showing a detailed configuration of the data line driving circuit 200 and sampling circuit 240. As shown in the figure, the data line driving circuit 200 includes a shift resistor unit 210 and an output signal control unit 220.

First, the shift resistor unit 210 includes shift resistor unit circuits Ua1 to Uan+2 in cascade connection with each other. Respective shift resistor unit circuits Ua1 to Uan+2 have clocked inverters 501 and 502, and inverters 503.

The clocked inverters 501 and 502 invert respective input signals when a control terminal voltage is high level and then output the signal, and make output terminals into high impedance state when the control terminal voltage is low level. The clock signal XCK and the inverted X clock signal XCKB, which are active only in a predetermined period, are supplied to respective control terminals of the clocked inverters 501 and 502. The output signals from the clocked inverters 501 are supplied to input terminals of the inverters 503.

In the shift resistor unit circuits Ua1, Ua3, . . . , at odd number stages, the clock signal XCK is supplied to the clocked inverters 501, and the inverted clock signal XCKB is supplied to the clocked inverters 502. In the shift resistor unit circuits Ua2, Ua4, . . . , at even number stages, the clock signal XCK is supplied to the clocked inverters 502, and the inverted clock signal XCKB is supplied to the clocked inverters 501.

In the shift resistor unit circuit Ua1, when the clock signal XCK is high level, the clocked inverter 501 inverts the X transfer starting pulse DX and then outputs the pulse. At this time, since the inverted clock signal XCKB is low level, the output terminal of the clocked inverter 502 is in a high impedance state. In this case, the X transfer starting pulse DX is output through the clocked inverter 501 and the inverter 503. On the other hand, when the inverted clock signal XCKB is high level, the clocked inverter 502 inverts the X transfer starting pulse DX and then outputs the pulse. At this time, since the clock signal XCK is low level, the output terminal of the clocked inverter 501 is in a high impedance state. In this case, the clocked inverter 502 and inverter 503 form a latched circuit.

The output signal control unit 220 has n+1 operational unit circuits Ub1 to Ubn+1. The operational unit circuits Ub1 to Ubn+1 are provided corresponding to the shift resistor unit circuits Ua2 to Uan+2 respectively, and output the positive sampling signals Sa1 to San and the negative sampling signals Sb1 to Sbn. Respective operational unit circuits Ub1 to Ubn have NAND circuits 511, inverters 512 and 513, and NAND circuits 514. The operational unit circuit Ubn+1 has a NAND circuit 511.

Each of the operational unit circuits Ub1 to Ubn can be considered as groups of a first operation part and a second operation part. The first operation part can be formed by the NAND circuit 511, and generates a signal that is enabled in a period while the output signals from the both shift resistor unit circuits are enabled at the same time based on an output signal from a shift resistor unit circuit and an output signal from a subsequent-stage shift resistor unit circuit.

The second operation part has a function of generating the positive sampling signal and negative sampling signal based on the output signal from the first operation part, and has a first system that generates the positive sampling signal and a second system that generates the negative sampling signal.

The inverters 512 are included in the first system, and invert the output signals from the NAND circuits 511 and generate the positive sampling signals Sa1 to San. The inverters 513 and NAND circuits 514 are included in the second system. The NAND circuit 514 acts as the logic circuit that controls enabling periods of the negative sampling signal based on output signal output from NAND circuit 511 in a subsequent-stage operational unit circuit.

Next, the sampling circuit 240 has n transfer gates SW1 to SWn. Respective transfer gates SW1 to SWn are formed by complementary TFTs, and are controlled by the positive sampling signals Sa1 to San and negative sampling signals Sb1 to Sbn. When respective sampling signals Sa1 to San and Sb1 to Sbn become sequentially active, respective transfer gates SW1 to SWn are sequentially turned on. Then, an image signal 40 supplied through an image signal supply line L1 is sampled and sequentially supplied to respective data lines 3.

Figure 3:
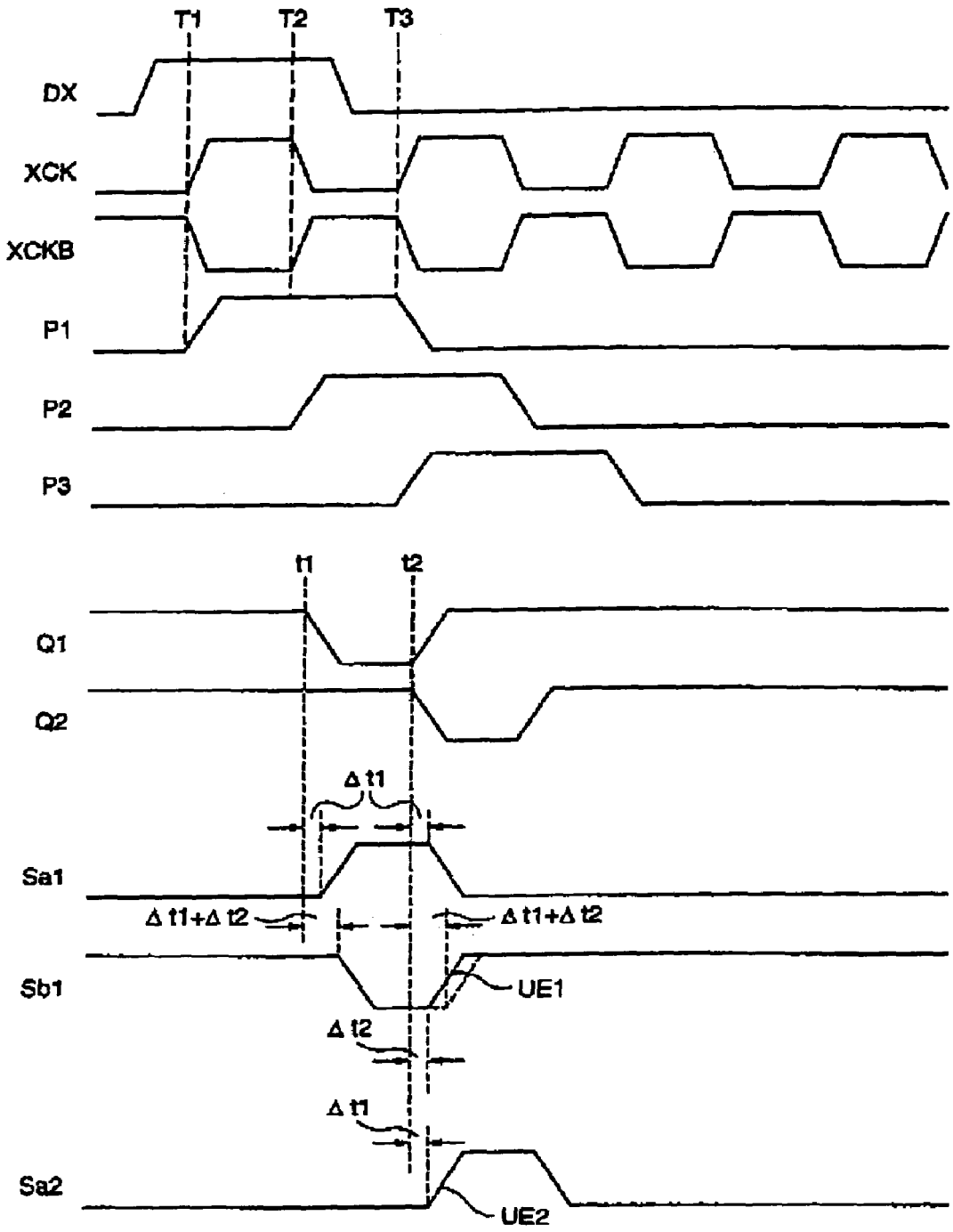
FIG. 3 is a timing chart of the data line driving circuit 200.

Next, operation of the data line driving circuit 200 is described with reference to FIG. 3. FIG. 3 is a timing chart showing an exemplary operation of the data line driving circuit 200.

First, operation of the first shift resistor unit circuit Ua1 is described. At the time of T1, the X clock signal XCK goes into high level, and the clocked inverter 501 becomes active. Therefore, a signal P1 falls from the high level to low level at the time of T1.

Then, at the time of T2, the X clock signal XCK goes into the low level, on the contrary, the inverted X clock signal XCKB goes into high level, therefore, the clocked inverter 501 becomes inactive, on the contrary, the clocked inverter 502 becomes active. Since the clocked inverter 502 and inverter 503 form the latched circuit, the signal P1 is maintained as the low level.

Then, at the time of T3, the X clock signal XCK goes into the high level, on the contrary, the inverted X clock signal XCKB goes into the low level, the signal P1 transits from the low level to the high level. Signals P2, P3 become half-cycle delayed signals of the clock signal XCK.

The NAND circuit 511 in the operational unit circuit Ub 1, based on the signal P1 and signal P2, operates the inversion of the logical products of the signals and thus generates an output signal Q1, and the NAND circuit 511 in the operational unit circuit Ub2, based on the signal P2 and signal P3, operates the inversion of the logical products of the signals and generates an output signal Q2. Therefore, waveforms of the output signals Q1 and Q2 become waveforms as shown in FIG. 3.

Here, assuming that a delay time of the inverters 512 and 513 is Δt1, logical level of the positive sampling signal Sa1 transits from the low level to the high level only the time Δt1 later than the time t1 when logical level of the output signal Q1 transits from the high level to the low level. The logical level of the positive sampling signal Sa1 transits from the high level to the low level only the time Δt1 later than the time t2 when the logical level of the output signal Q1 transits from the low level to the high level.

Next, assuming that the delay time of the inverter 512 is Δt1, the logical level of the positive sampling signal Sa1 transits from the low level to the high level only the time Δt1 later than the time t1 when the logical level of the output signal Q1 transits from the high level to the low level. The logical level of the positive sampling signal Sa1 transits from the high level to the low level only the time Δt1 later than the time t2 when the logical level of the output signal Q1 transits from the low level to the high level.

Assuming that the delay time of the NAND circuit 514 is Δt2, the logical level of the negative sampling signal Sb1 transits from the high level to the low level only a time Δt1+Δt2 later than the time t1. Here, when the NAND circuit 514 is a simple inverter, a rising edge of the negative sampling signal Sb1 occurs only the time Δt1+Δt2 later than the trailing time t2 of the output signal Q1 as shown by a dashed line in FIG. 3.

However, since the signal Q2 output from the NAND circuit 511 in the subsequent-stage operational unit circuit Ub2 is supplied to one input terminal of the NAND circuit 514, a rising edge UE of the negative sampling signal Sb1 is affected by the signal Q2. That is, a period while the negative sampling signal Sb1 is enabled, is controlled based on the output signal Q2, and the rising edge UE of the negative sampling signal Sb1 occurs only the time Δt2 later than the trailing time t2 of the output signal Q2. Thus, an endpoint of the enabling period of the positive sampling signal Sa1 can be substantially agreed with an endpoint of the enabling period of the negative sampling signal Sb1.

Since the positive sampling signal Sa2 is inversion of the output signal Q1 with delay of only the time Δt1, the rising edge UE2 of the positive sampling signal Sa2 and rising edge UE1 of the negative sampling signal Sb1 occur substantially at the same time. Thus, an overlapped period of the enabling period of the negative sampling signal Sb1 and the enabling period of the positive sampling signal Sa2 can be substantially eliminated. Particularly, when a transistor size in each logic circuit is determined such that relation between the delay time Δt2 of the NAND circuit 514 and the delay time Δt1 of the inverters 512 and 513 is Δt2<Δt1, the overlap among the enabling periods can be completely eliminated.

Thus, the transfer gates SW1 to SWn shown in FIG. 2 go into on state exclusively. As a result, the image signal 40 is sampled at a predetermined timing and supplied to respective data lines 3 as the data line signals X1 to Xn, therefore a data line signal that should be supplied to a particular data line 3 can be prevented from being supplied to adjacent data lines 3. Consequently, according to this liquid crystal panel AA, occurrence of so-called ghost can be prevented and a clear image can be displayed without bleeding.

According to the embodiment, since the pulse width of the sampling signal is not limited using the enabling signal or inhibiting signal, the overlap of the enabling periods among respective sampling signals can be prevented even when an operating frequency of the data line driving circuit 200 is increased.

When the enabling signal or inhibiting signal is used, wiring is necessary for transmitting the signals, and since a floating capacitor is generated in such wiring, electric power is consumed significantly in a supplying circuit for supplying the enabling signal or the inhibiting signal, however, according to the embodiment, since the wiring and supplying circuit are unnecessary, a simple configuration in addition to the reduced power consumption can be achieved. This point is particularly important when the liquid crystal panel AA is used as a display unit for a portable electronic instrument driven by the battery of cellular phone, and the like.

Figure 4:
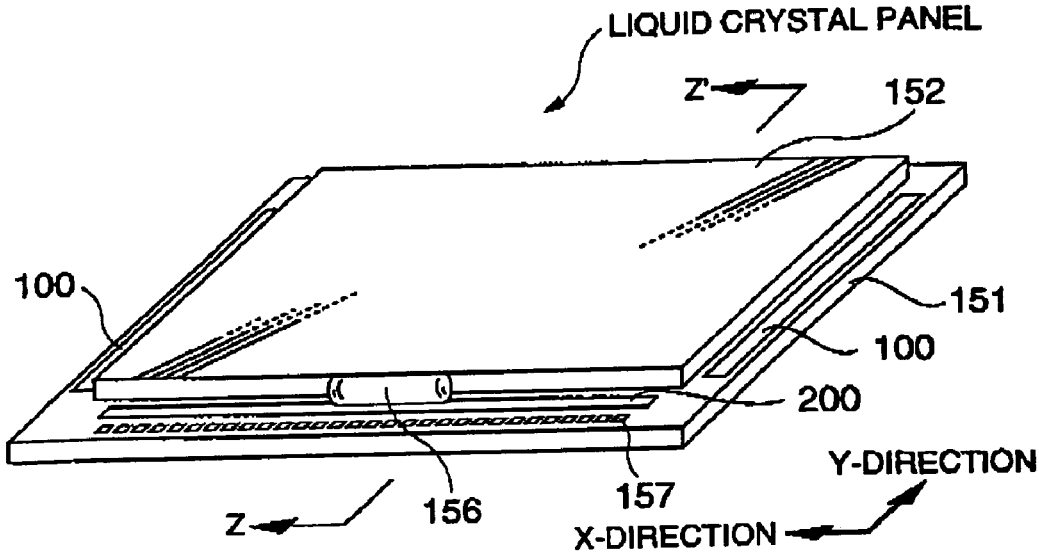
FIG. 4 is a perspective view for illustrating the configuration of the liquid crystal panel.
Figure 5:
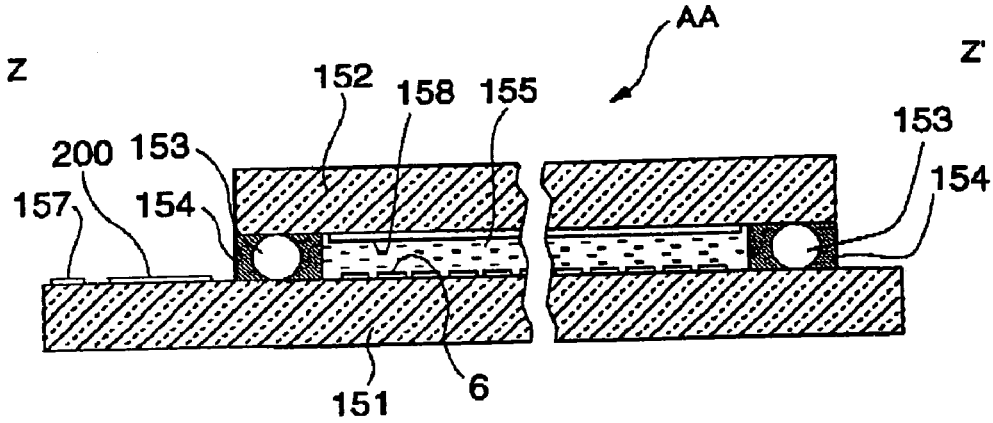
FIG. 5 is a partially sectional view for illustrating the configuration of the liquid crystal panel.

Next, general configuration of the liquid crystal panel according to the above mentioned electrical configuration is described with reference to FIG. 4 and FIG. 5. Here, FIG. 4 is a perspective view showing a configuration of the liquid crystal panel AA, and FIG. 5 is a sectional view along the line Z–Z' in FIG. 4.

As shown in the figures, the liquid crystal panel AA has a structure in which an element substrate 151, such as a glass or semiconductor substrate on which pixel electrodes 6 etc. are formed and a transparent counter substrate 152, such as a glass substrate on which common electrodes 158 etc. are formed, are adhered with keeping a fixed clearance using a sealing member 154 in which spacers 153 are mixed such that surface for forming the electrodes are faced with each other, and liquid crystal 155 as the electro-optic material is enclosed in the clearance. Although the sealing member 154 is formed along the circumference of the counter substrate 152, the member 154 is partially opened to enclose the liquid crystal 155. Therefore, after the liquid crystal 155 is enclosed, the opened area is sealed by sealing material 156.

Here, it is configured that on one outer side of the sealing member 154, which is a surface facing to the element substrate 151, the above mentioned data line driving circuit 200 is formed to drive the data lines 3 extending in Y direction. Furthermore, it is configured that a number of contact electrodes 157 are formed on this one side to input various signals from the timing generation circuit 300 and image signals 40R, 40G, and 40B. Moreover, it is configured that the scan line driving circuits 100 are formed on two side adjacent to this one side to drive the scan lines 2, extending in X direction, from both sides.

On the other hand, the common electrodes 158 on the counter substrate 152 is designed to conduct electrically with the element substrate 151 by a conduction member provided in at least one corner in the four corners at which the counter substrate 152 is adhered with the element substrate 151. Besides, on the counter substrate 152, depending on use of the liquid crystal panel AA, for example, firstly, a color filter arranged in a stripe pattern, mosaic pattern, or triangle pattern etc. is provided, secondly, a black matrix having, for example, metal material, such as chromium and nickel, or resin black in which carbon or titanium etc. is dispersed in photoresist is provided, and thirdly, a backlight for irradiating light onto the liquid crystal panel AA is provided. Particularly, in case of color light modulation use, the black matrix is provided on the counter substrate 152 without forming the color filter.

In addition, while respective orientation films etc. subjected to rubbing in a predetermined direction are provided on the faced surface of the element substrate 151 and counter substrate 152, respective polarizing plates (not shown) corresponding to the orientation direction are provided at respective backsides of the substrates. However, when a polymer-dispersed type liquid crystal, in which liquid crystal is dispersed in a polymer as small particles, is used as the liquid crystal 155, the orientation films and the polarizing plates etc. are unnecessary, as a result, usability of light is improved, therefore advantages are achieved in a point of improvement of luminance or reduction of power consumption.

Instead of forming part or all of peripheral circuits, such as the data line driving circuit 200 and scan line driving circuit 100 on the element substrate 151, for example, a configuration where a driving IC chip mounted on a film using TAB (Tape Automated Bonding) technique may be connected electrically and mechanically through an anisotropically conductive film provided on a predetermined position in the element substrate 151, or a configuration where the driving IC chip itself may be connected electrically and mechanically to the predetermined position in the element substrate 151 through the anisotropically conductive film using COG (Chip On Grass) technique.

The above mentioned data line driving circuit 200 was corresponding to the positive logic where the X transfer starting pulse DX was active at high level. A data line driving circuit 200' that is a modified example of the circuit 200 is corresponding to the negative logic where the X transfer starting pulse DX is active at low level.

Figure 6:
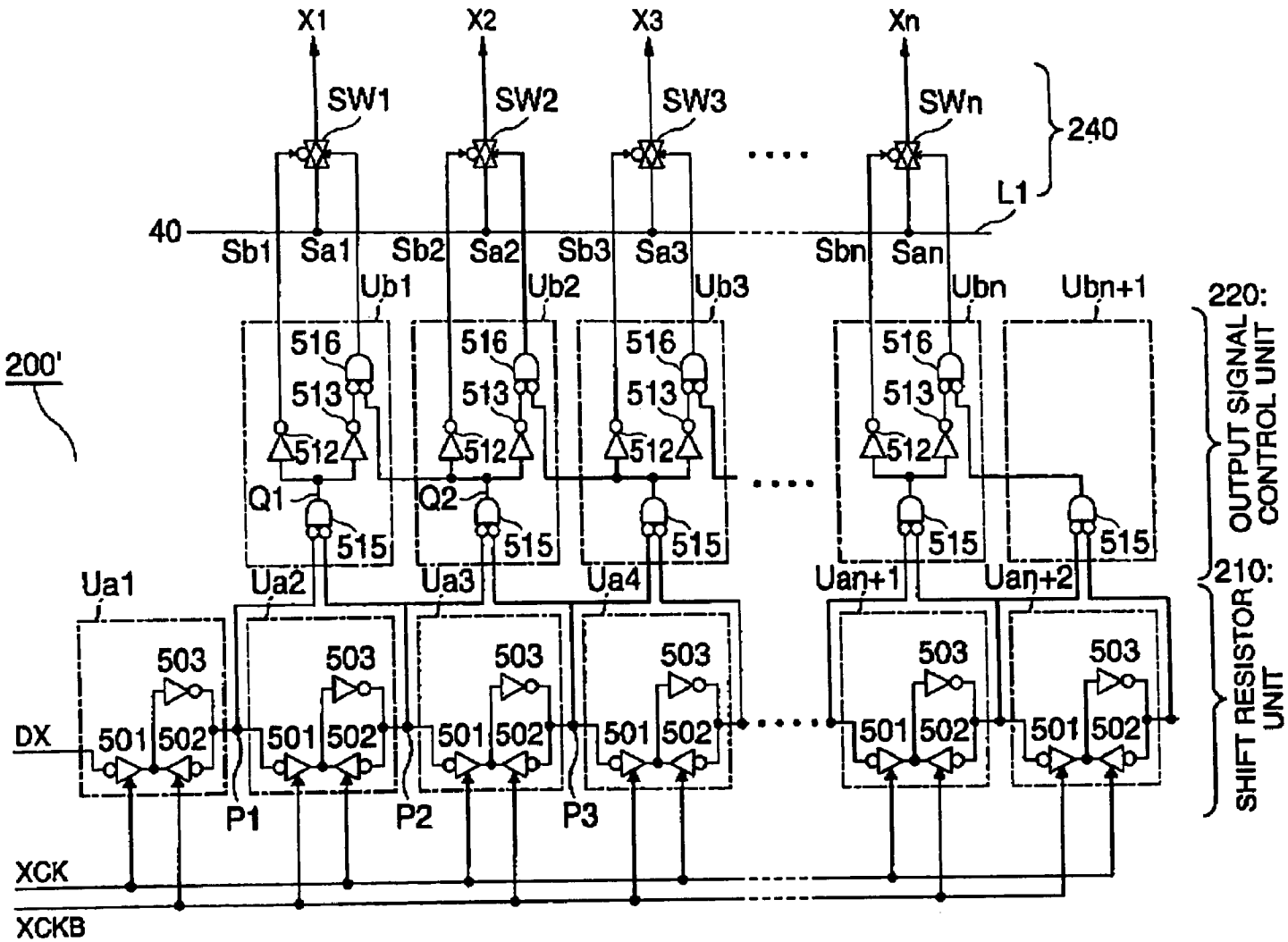
FIG. 6 is an exemplary circuit diagram of the data line driving circuit 200' corresponding to a negative logic.
Figure 7:
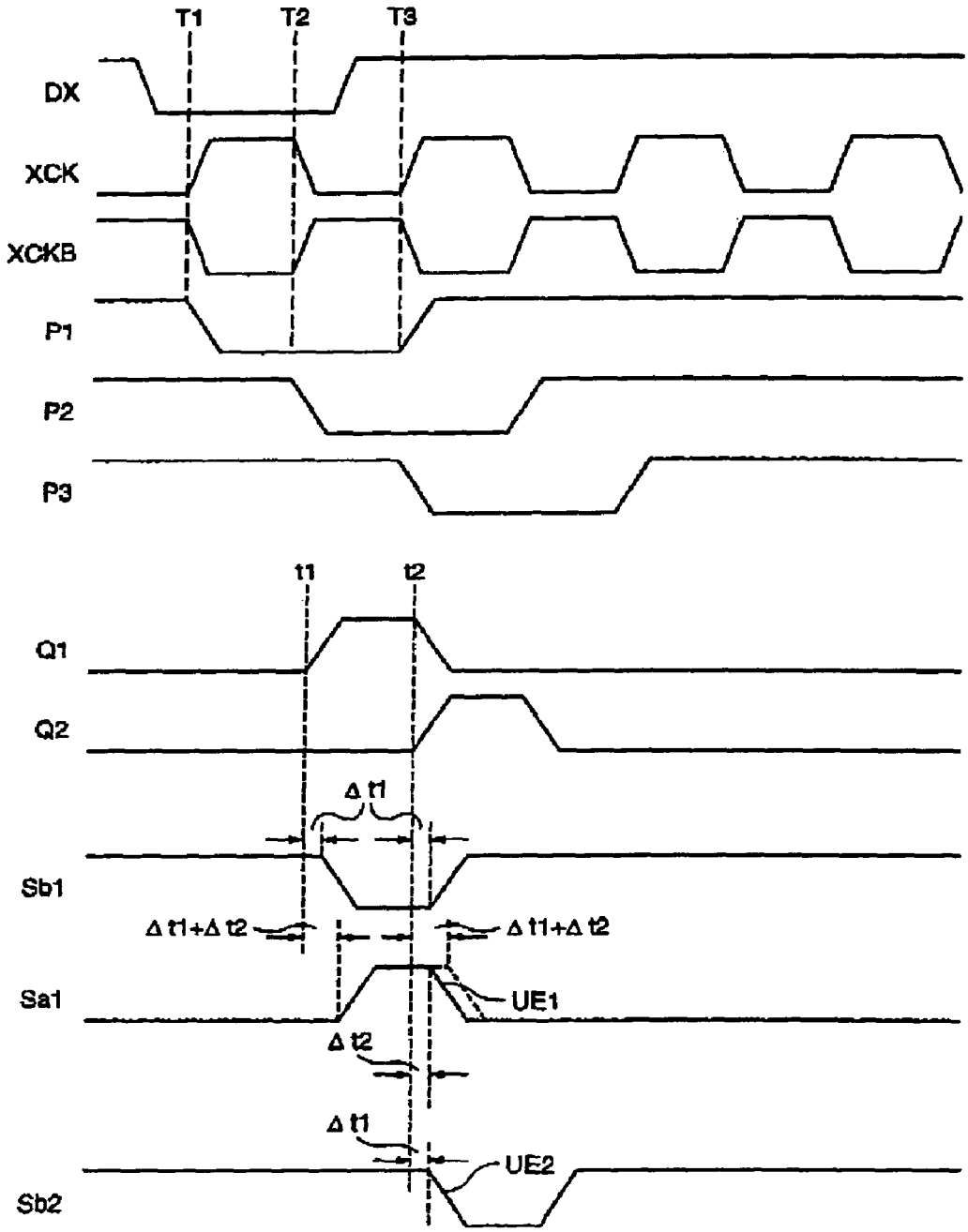
FIG. 7 is a timing chart of the data line driving circuit 200'.

FIG. 6 is an exemplary circuit diagram showing a detailed configuration of the data line driving circuit 200', and FIG. 7 is a timing chart of the circuit. The data line driving circuit 200' is same as the above mentioned data line driving circuit 200 except for a point that the NAND circuits 511 are replaced by the NOR circuits 515 and a point that the NAND circuits 514 are replaced by the NOR circuits 516 in the operational unit circuits Ub1 to Ubn.

As shown in FIG. 7, since the X transfer starting pulse DX is active at low level, the signals P1, P2, . . . , are active at low level, and the output signals Q1, Q2, . . . , from the NOR circuit 515 are active at high level. Therefore, the positive sampling signals Sa1, Sa2, . . . , are generated by inverting the output signals Q1, Q2, . . . , twice. On the other hand, the negative sampling signals Sb1, Sb2, . . . , are generated by inverting the output signals Q1, Q2, . . . , once. Therefore, in this example, the system for generating the positive sampling signals Sa1, Sa2, . . . , has a long delay time compared with a system for generating the negative sampling signals Sb1, Sb2, . . . . Therefore, the NOR circuits 516 are used in the system for generating the positive sampling signals Sa1, Sa2, . . . , thereby enabling periods of the positive sampling signals Sa1, Sa2, . . . , are limited by the output signals from the subsequent-stage NOR circuits 515.

Thus, an overlapped period of the enabling period of the positive sampling signal Sa1 and the enabling period of the negative sampling signal Sb2 can be substantially eliminated. Particularly, when a transistor size in each logic circuit is determined such that relation between a delay time $\Delta t2$ of the NOR circuit 516 and a delay time $\Delta t1$ of the inverters 512 and 513 is $\Delta t2<\Delta t1$, the overlap among the enabling periods can be completely eliminated.

Figure 8:
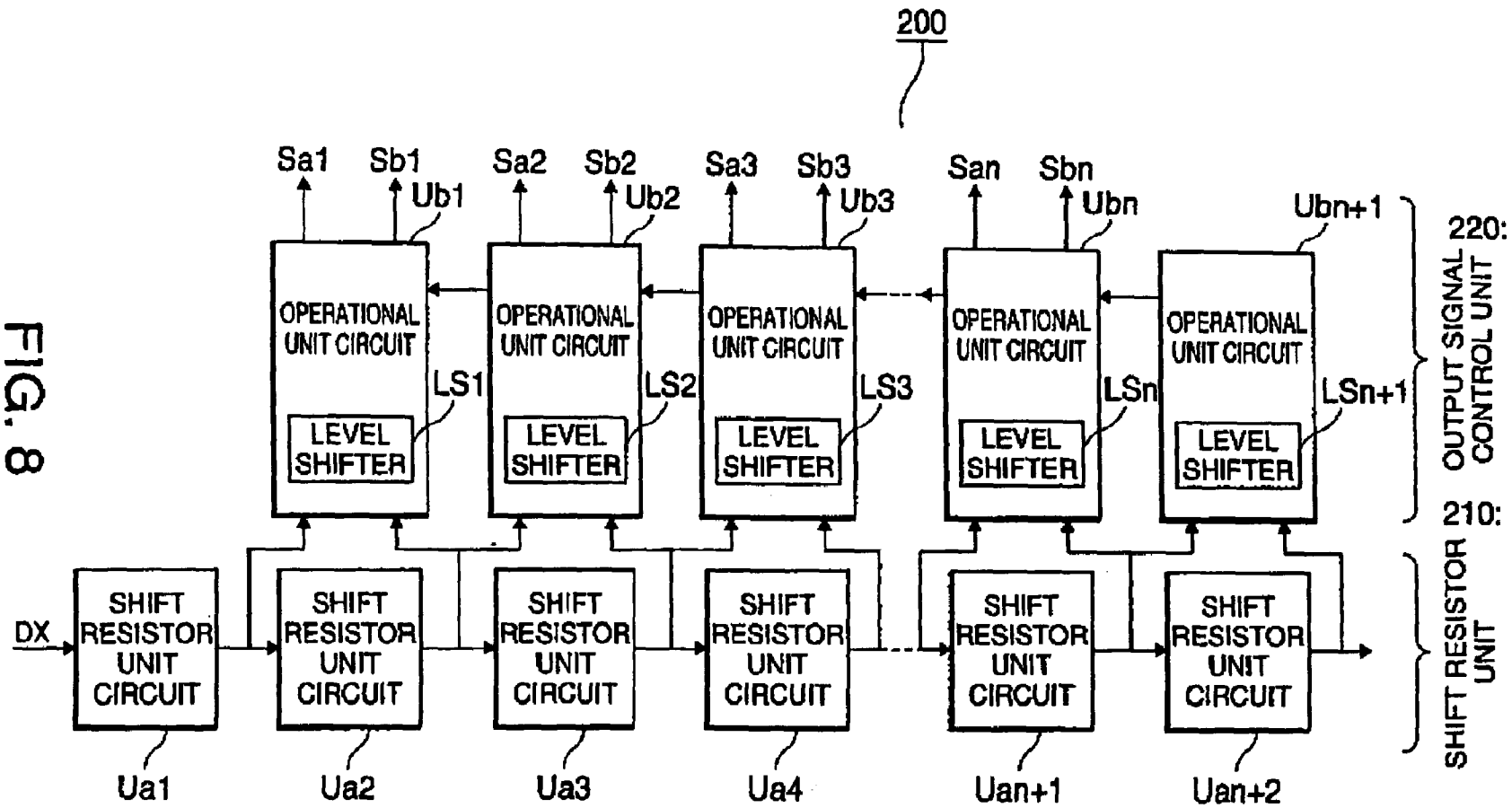
FIG. 8 is an exemplary block diagram of the data line driving circuit 200 including a level shifter.

The above mentioned data line driving circuits 200 and 200' may include a level shifter. FIG. 8 shows an example of a configuration of the data line driving circuits 200 including the level shifter. As shown in the figure, respective operational unit circuits Ub1 to Ubn+1 forming the output signal control unit 220, have level shifters LS1 to LSn+1. Each of the level shifters performs a level conversion of an input signal and generates an output signal.

Figure 9:
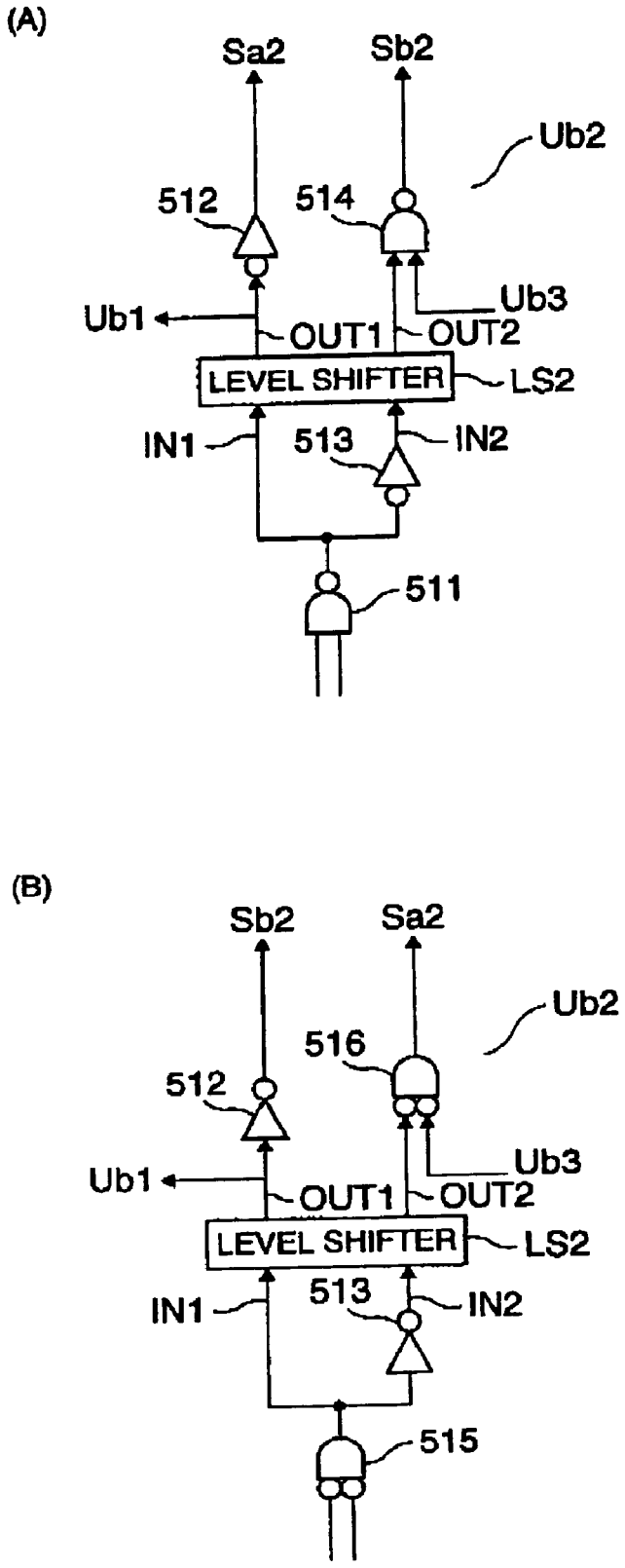
FIG. 9 is an exemplary circuit diagram of the operational unit circuit Ub2 including the level shifter.

FIG. 9(A) is an exemplary circuit diagram of the operational unit circuit Ub2 for use in the data line driving circuit 200. A level shifter LS2, based on an output signal IN1 from the NAND circuit 511 and an output signal IN2 from the inverter 513, converts voltage levels of respective signals IN1 and IN2 and outputs output signals OUTI and OUT2. For example, assuming that there is a relation of Vss<Vdd<Vhh among electric potentials Vss, Vdd, and Vhh, and the signals IN1 and IN2 are fluctuated between the electric potential Vss and electric potential Vdd, the signals OUTI and OUT2 are fluctuated between the electric potential Vss and electric potential Vhh.

The reason for providing the level shifter LS2 before the NAND circuit 514 in this way is to perform a timing adjustment for a signal after performing the level shift, since an edge slope of a signal waveform becomes gentle during the level shift, which may cause the overlap among the enabling periods.

Therefore, the level shifter may be provided in any place as long as it is previous to the NAND circuit 514, for example, the level shifter may be provided in a previous stage of the shift resistor unit circuit Ua1 to convert a signal amplitude of the X transfer starting pulse DX, or may be provided right before the operational unit circuit Ub2. The operational unit circuit Ub2 in the data line driving circuit 200' corresponding to the negative logic can also incorporate the level shifter. FIG. 9(B) shows a circuit diagram of the circuit Ub2.

Figure 10:
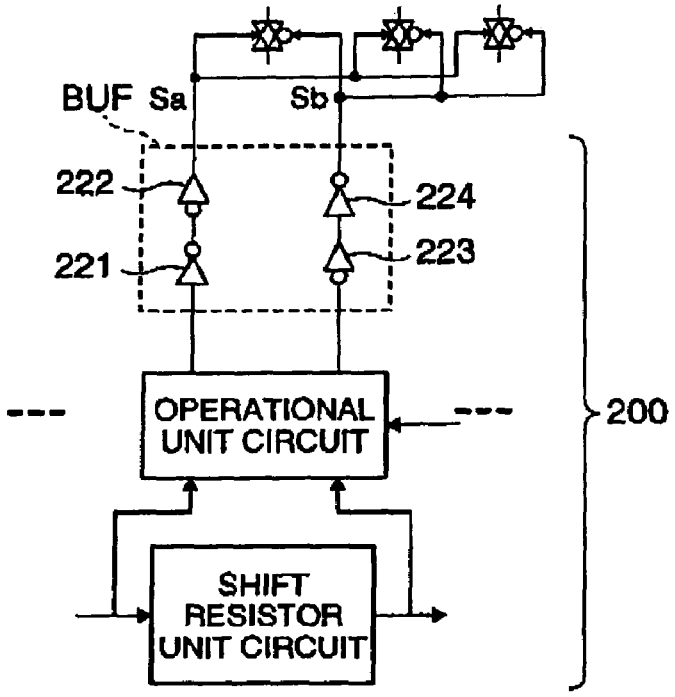
FIG. 10 is an exemplary block diagram of the data line driving circuit 200 including a buffer circuit.

The above mentioned data line driving circuits 200 and 200' may include a buffer circuit. FIG. 10 is an exemplary circuit diagram showing part of the data line driving circuits 200 including the buffer circuit and its peripheral configuration. In this example, it is assumed that the positive sampling signal Sa and negative sampling signal Sb drive three transfer gates. In such case, since electric current is consumed significantly compared with a case of driving one transfer gate, it is preferable to provide a buffer circuit BUF shown in the figure.

The buffer circuit BUF is formed by four inverters 221 to 224. By increasing a size of transistors forming the inverters 221 to 224, the output electric current can be increased.

Figure 11:
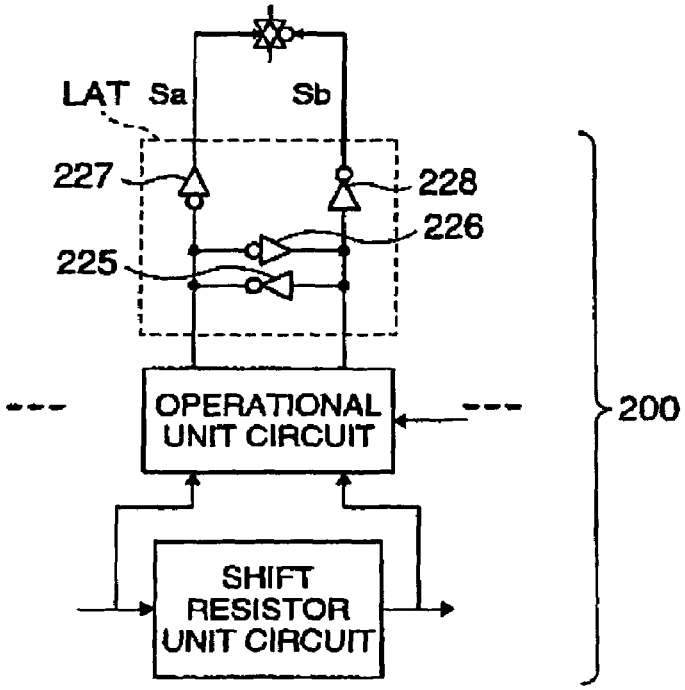
FIG. 11 is an exemplary block diagram of the data line driving circuit 200 including a latched circuit.

The above mentioned data line driving circuits 200 and 200' may include a latched circuit. FIG. 11 is an exemplary circuit diagram showing part of the data line driving circuits 200 including the latched circuit and its peripheral configuration. The latched circuit LAT is formed by inverters 225 to 228. The inverters 225 and 226 connected in a ring pattern can agree the pulse width of the positive sampling signal Sa and negative sampling signal Sb with each other, in addition, can further reduce the overlap among the adjacent sampling signals.

In each of the above mentioned embodiments, although it has been described that the element substrate 151 of the liquid crystal panel is formed from a transparent, insulating substrate, such as glass, and a thin silicon film is formed on that substrate, and TFT having a source, drain, and channel formed on that thin film forms the switching element for the pixel (TFT 50), or elements for the data line driving circuit 200 and scan line driving circuit 100, it should be understood that the invention is not limited to this.

For example, the element substrate 151 may be formed using a semiconductor substrate, and thus the switching elements for pixels or various circuit elements may be formed by an insulated gate type field effect transistor having the source, drain, and channel formed on a surface of that semiconductor substrate. In this way, when the element substrate 151 is formed using the semiconductor substrate, since the substrate cannot be used as a transmission type display panel, and the substrate, on which the pixel electrode 6 is formed using aluminum, is used as a reflection type. Simply, the element substrate 151 may be a transparent substrate, and the pixel electrode 6 may be a reflection type.

Furthermore, in the above mentioned embodiments, the switching element for pixel has been described as a three-terminal element exemplified by TFT, however, the switching element may be a two-terminal element, such as diode. However, when the two-terminal element is used as the switching element for pixel, the scan lines 2 are formed on one substrate and the data lines 3 are formed on the other substrate, in addition, the two-terminal element must be formed between either one of the scan line 2 or the data line 3 and the pixel electrode. In this case, the pixel is formed by the two-terminal element connected in series between the scan line 2 and the data line 3, and the liquid crystal.

Although the invention has been described as an active matrix type liquid crystal display apparatus, it should be understood that the invention is not limited to this, and applicable for a passive type using STN (Super Twisted Nematic) liquid crystal. Furthermore, the invention is also applicable for a display apparatus that employs, in addition to the liquid crystal, an electro-luminescence element as the electro-optic material, and performs a display action by the electro-optic effect of the device. That is, the invention can be applied to any electro-optic apparatus having a similar configuration as the above mentioned liquid crystal apparatus.

Next, a description is made regarding a case that the above mentioned liquid crystal apparatus is applied to various electronic instruments.

Figure 12:
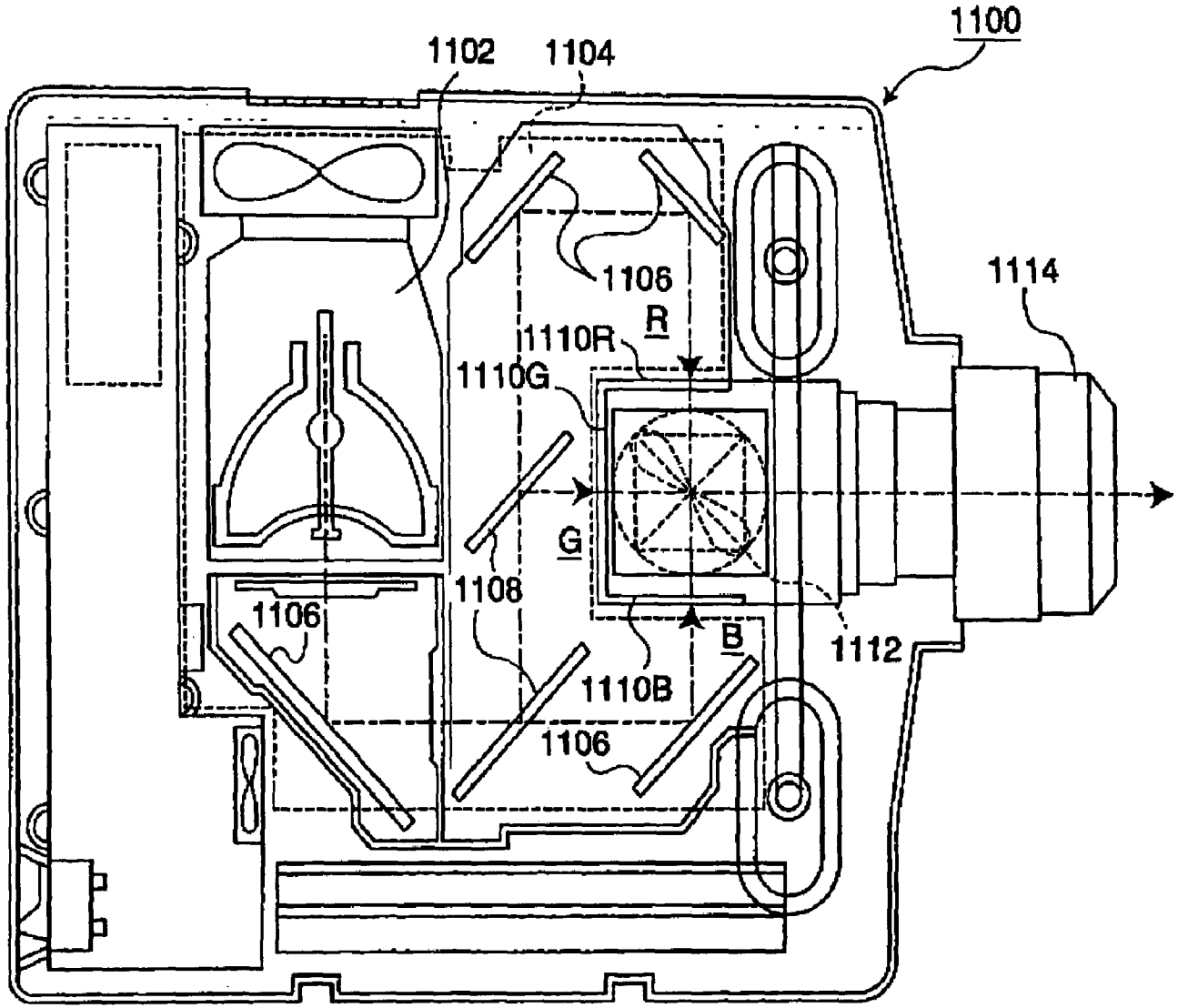
FIG. 12 is a sectional view of a video projector as an example of the electronic instruments to which the liquid crystal apparatus is applied.

First, a projector in which the liquid crystal apparatus is used as a light valve is described. FIG. 12 is a plan view showing an example of configuration of the projector. As shown, a lamp unit 1102 having a white light source, such as a halogen lamp, is provided within a projector 1100. A projection light emitted from the lamp unit 1102 is separated into three primary colors of R, G, and B by four mirrors 1106 and two dichroic mirrors 1108 arranged in the light guide 1104, and injected onto liquid crystal panels 110R, 1110B, and 1110G as light valves corresponding to respective primary colors.

The liquid crystal panels 1110R, 1110B, and 1110G are formed in the same manner as the above mentioned liquid crystal panel AA, and driven by primary color signals of R, G, and B supplied from the image signal processing circuit (not shown) respectively. The light modulated in these liquid crystal panels is injected into a dichroic prism 1112 from three directions. In the dichroic prism 1112, while the light R and light B is refracted at 90 degrees, the light G advances straight. Therefore, respective color images are composed, as a result, a color image is projected onto a screen etc. through a projection lens 1114.

Here, attention is made to display images by respective liquid crystal panels 1110R, 1110B, and 1110G. The display image by the liquid crystal panel 1110G is required to be a mirror-reversed image with respect to the display images by the liquid crystal panels 1110R and 1110B.

The liquid crystal panels 110R, 1110B, and 1110G need not have color filters, since the light corresponding to each of primary colors R, G, and B is injected to the panels by the dichroic mirror 1108.

Figure 13:
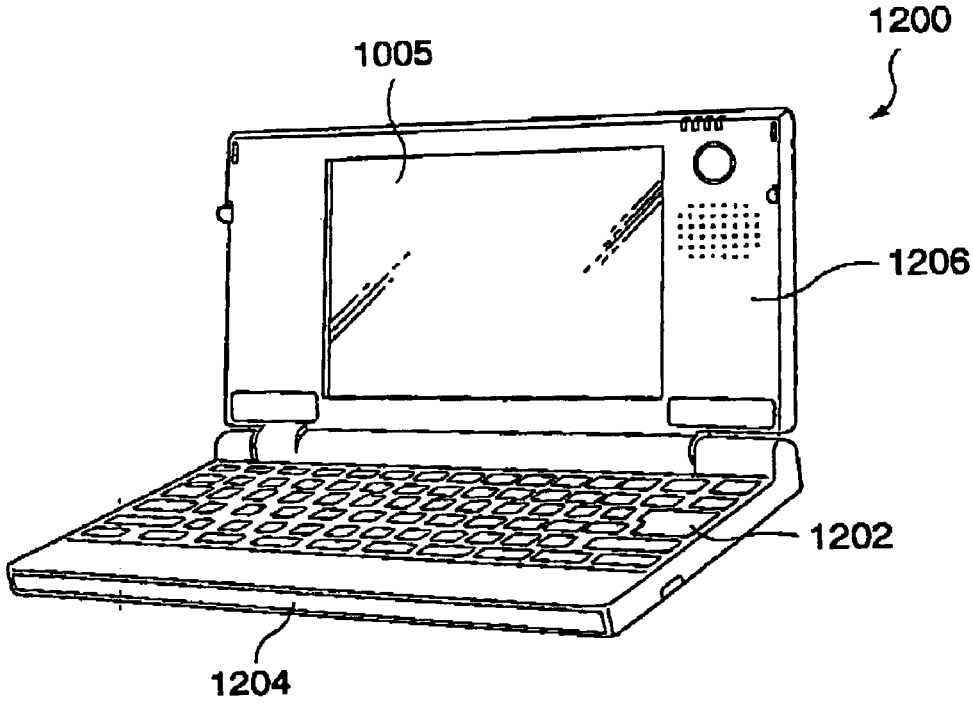
FIG. 13 is a perspective view showing a configuration of a personal computer as an example of the electronic instruments to which the liquid crystal apparatus is applied.

Next, a description is made regarding an example where the liquid crystal panel is applied to a mobile type personal computer. FIG. 13 is a perspective view showing a configuration of the personal computer. In the figure, a computer 1200 is formed by a body 1204 having a keyboard 1202, and a liquid crystal display unit 1206. The liquid crystal display unit 1206 is formed by adding a backlight on a back of the above mentioned liquid crystal panel 1005.

Figure 14:
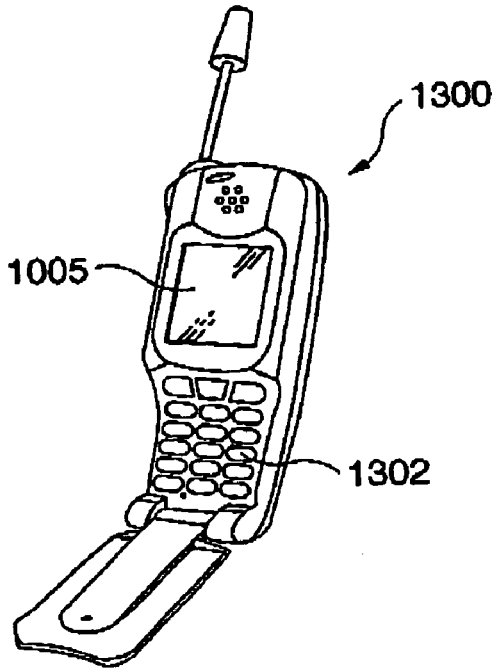
FIG. 14 is a perspective view showing a configuration of a cellular phone as an example of the electronic instruments to which the liquid crystal apparatus is applied.

Furthermore, an example where the liquid crystal panel is applied to a cellular phone is described. FIG. 14 is a perspective view showing a configuration of the cellular phone. In the figure, a cellular phone 1300 has a number of operating buttons 1302, as well as reflection type liquid crystal panel 1005. The reflection type liquid crystal panel 1005 has a front light on its front face as needed.

In addition to the electronic instruments described with reference to FIG. 11 to FIG. 13, an apparatus having a liquid crystal television, viewfinder type or monitor direct-view type video tape recorder, car navigation apparatus, pager, personal digital assistance, desk-top calculator, word processor, workstation, video phone, point of sales terminal, or touch panel can be listed. It should be understood that the invention can be applied to the various electronic instruments.

As described above, according to the invention, the period while an enabling period of a set of a positive logic output signal and negative logic output signal is overlapped with an enabling period of a set of the subsequent positive logic output signal and negative logic output signal can be drastically reduced. The electro-optic apparatus to which the invention is applied can display a high-definition, clear image.

What is claimed is:

1. An output control circuit, which is used together with transfer means in which a number of unit circuits that shift a starting pulse sequentially in synchronization with a clock signal are in cascade connection with each other, and generates a set of a positive logic output signal and a negative logic output signal which is an inversion of the positive logic output signal based on an output signal from each of the unit circuits, the output control circuit having, a first logic operation unit which, based on an output signal from a unit circuit and an output signal from a subsequent-stage unit circuit, generates an output signal that is enabled in a period while the output signals from the two unit circuits are enabled at the same time, and, a second logic operation unit which generates the positive logic output signal and the negative logic output signal based on the output signal from the first logic operation unit, and controls an enabling period of the positive logic output signal or the negative logic output signal based on the output signal from a first logic operation unit in a subsequent-stage output control circuit.

2. The output control circuit according to claim 1 characterized in that the second logic operation unit has a first system that generates the positive logic output signal based on the output signal from the first logic operation unit, and a second system that generates the negative logic output signal based on the output signal from the first logic operation unit, wherein one of a system, the first system or the second system, having a longer delay time has a logic circuit that controls an enabling period of the positive logic output signal or the negative logic output signal which should be generated in one of the system based on the output signal from the first logic operation unit in the subsequent-stage output control circuit.

3. The output control circuit according to claim 2 characterized in that the output signal from the first logic operation unit is enabled at low level, and the logic circuit in the second logic operation unit is a NAND circuit that is included in the second system, and controls the enabling period of the negative logic output signal based on the output signal from the first logic operation unit in the subsequent-stage output control circuit.

4. The output control circuit according to claim 3 characterized in that the output signal from the unit circuit is enabled at high level, the first logic operation unit has a NAND circuit, the first system in the second logic operation unit has a first inverting circuit that inverts an output signal from the NAND circuit in the first logic operation unit and then outputs the signal as the positive logic output signal, the second system in the second logic operation unit has a second inverting circuit that inverts the output signal from the NAND circuit in the first logic operation unit and then outputs the signal, and the logic circuit that operates inversion of a logical product of the output signal from the second inverting circuit and the output signal from the first logic operation unit in the subsequent-stage output control circuit and then outputs the inversion of the logical product as the negative logic output signal.

5. The output control circuit according to claim 2 characterized in that the output signal from the first logic operation unit is enabled at high level, and the logic circuit in the second logic operation unit is a NOR circuit that is included in the first system, and controls the enabling period of the positive logic output signal based on the output signal from the first logic operation unit in the subsequent-stage output control circuit.

6. The output control circuit according to claim 5 characterized in that the output signal from the unit circuit is enabled at low level, the first logic operation unit has a NOR circuit, the second system in the second logic operation unit has a first inverting circuit that inverts an output signal from the NOR circuit in the first logic operation unit and then outputs the signal as the negative logic output signal, and the first system in the second logic operation unit has a second inverting circuit that inverts the output signal from the NOR circuit in the first logic operation unit and then outputs the signal, and the logic circuit that operates the inversion of the logical sum of the output signal form the second inverting circuit and the output signal from the first logic operation unit in the subsequent-stage output control circuit and then outputs the inversion of the logical sum as the positive logic output signal.

7. The output control circuit according to claim 2 characterized by having a level conversion circuit that converts amplitude of signal in a previous stage of the logic circuit.

8. The output control circuit according to claim 7 characterized in that the output signal from the unit circuit is enabled at high level, the first logic operation unit has the NAND circuit, and the second logic operation unit has the second inverting circuit that inverts the output signal from the NAND circuit in the first logic operation unit, the level conversion circuit that converts an amplitude of each signal of the output signal from the NAND circuit in the first logic operation unit and the output signal from the second inverting circuit and then outputs the signal, a first inverting circuit that inverts the output signal, which is level converted, from the NAND circuit in the first logic operation unit, and then outputs the signal as the positive logic output signal, and the logic circuit that operates the inversion of the logical product of the output signal, which is level converted, from the second inversion circuit, and the output signal, which is level converted in the subsequent-stage output control circuit, from the first logic operation unit, and then outputs the inversion of the logical product as the negative logic output signal.

9. The output control circuit according to claim 7 characterized in that the output signal from the unit circuit is enabled at low level, the first logic operation unit has the NOR circuit, and the second logic operation unit has a second inverting circuit that inverts the output signal from the NOR circuit in the first logic operation unit, the level conversion circuit that converts the amplitude of each signal of the output signal from the NOR circuit in the first logic operation unit and the output signal form the second inverting circuit and then outputs the signal, a first inverting circuit that inverts the output signal, which is level converted, from the NOR circuit in the first logic operation unit, and then outputs the signal as the negative logic output signal, and the logic circuit that operates the inversion of the logical sum of the output signal, which is level converted, from the second inverting circuit, and the output signal, which is level converted in the subsequent-stage output control circuit, from the first logic operation unit, and then outputs the inversion of the logical sum as the positive logic output signal.

10. The output control circuit according to claim 1 characterized by having an electric current amplification unit that is provided in a later stage of the second logic operation unit and performs an electric current amplification for respective output signals from the second logic operation unit and then outputs the signals as the positive logic output signal and the negative logic output signal.

11. The output control circuit according to claim 1 characterized by having a holding unit provided in a later stage of the second logic operation unit for holding respective output signals from the second logic operation unit bi-directionally, wherein respective signals from the holding unit are output as the positive logic output signal and the negative logic output signal.

12. A driving circuit, which drives an electro-optic apparatus having a number of scan lines, a number of data lines, pixel electrodes and switching elements arranged in a matrix pattern corresponding to intersections of the scan lines and the data lines, the driving circuit characterized by having, a transfer means in which unit circuits that shifts a starting pulse sequentially in synchronization with a clock signal are in a cascade connection with each other, and an output control means having a number of the output control circuits according to claim 1.

13. An electro-optic apparatus characterized by having, a number of the scan lines, a number of the data lines, the pixel electrodes and the switching elements arranged in a matrix pattern corresponding to the intersections of the scan lines and the data lines, a image signal line through which an image signal is supplied, a number of switching circuits provided corresponding to each of the data lines, in which an on/off control is performed by a set of a control signal that is enabled at high level and a control signal that is enabled at low level, and one terminal is connected to the data line and the other terminal is connected to the image signal line, and the driving circuit according to claim 12, which supplies the positive logic output signal and the negative logic output signal to each of the switching circuits as the set of the control signals.

14. An electronic instrument characterized by having the electro-optic apparatus according to claim 13.

* * * * *